US005740710A

United States Patent [19]

Gross et al.

[11] Patent Number: 5,740,710

[45] Date of Patent: Apr. 21, 1998

[54] DEVICE FOR CUTTING SHEETS OF MATERIAL

[75] Inventors: Helmut Gross, Hofheim; Adolf Rasch, Wiesbaden-Breckenheim, both of Germany

[73] Assignee: Adolf Mohr Maschinenfabrik GmbH & Co. KG, Hofheim am Taunus, Germany

[21] Appl. No.: 591,142

[22] Filed: Jan. 25, 1996

[30] Foreign Application Priority Data

Jan. 26, 1995 [DE] Germany ..... 195 02 291

[51] Int. Cl.[6] ..... B26D 7/02; B26D 7/22

[52] U.S. Cl. ..... 83/375; 83/DIG. 1; 83/459; 83/462; 83/463; 83/699.11; 269/159

[58] Field of Search ..... 83/DIG. 1, 462, 83/463, 459, 588, 589, 375, 639.1, 456, 698.11, 698.31, 699.11, 699.41, 699.61; 269/157, 159, 32

[56] References Cited

U.S. PATENT DOCUMENTS

| | | | |
|---|---|---|---|
| 53,169 | 3/1866 | Montague | 83/462 X |
| 368,672 | 8/1887 | James | 83/462 X |
| 440,195 | 11/1890 | Porter | 269/157 X |
| 734,819 | 7/1903 | Clapp | 83/462 |
| 773,742 | 11/1904 | Hilsinger | 83/462 X |
| 915,532 | 3/1909 | Appelberry | 83/462 X |
| 1,018,380 | 2/1912 | Smith | 269/159 X |
| 1,091,655 | 3/1914 | Hampp | 83/462 X |
| 1,547,828 | 7/1925 | Schroeter | 269/157 X |
| 1,909,598 | 5/1933 | Toohey et al. | 83/463 X |
| 2,397,896 | 4/1946 | Wehr | 83/459 X |
| 2,445,248 | 7/1948 | Spiller | 269/32 X |
| 2,506,436 | 5/1950 | Seybold | 269/32 X |
| 2,506,651 | 5/1950 | Seybold | 269/32 X |
| 2,507,581 | 5/1950 | Waters et al. | 269/32 X |
| 3,754,491 | 8/1973 | Kraus | 83/639.1 X |
| 3,820,773 | 6/1974 | Aizawa | 269/32 X |
| 4,561,479 | 12/1985 | Burdine | 269/157 X |

FOREIGN PATENT DOCUMENTS

| | | | |
|---|---|---|---|
| 2635604 | 2/1978 | Germany | 83/DIG. 1 |
| 2727817 | 1/1979 | Germany | 83/DIG. 1 |

*Primary Examiner*—Rinaldi I. Rada
*Assistant Examiner*—Boyer Ashley
*Attorney, Agent, or Firm*—Max Fogiel

[57] ABSTRACT

Device for cutting sheets of material, with a counter (12) for the material to rest on, a blade to cut the material, and a holdfast (11) that can be lowered onto the material by a mechanism (10) and raised off it by a spring (6). When the spring in such a device breaks, the holdfast can drop and injure the operator. The object is to prevent such injuries. An interceptor (7, 8, & 9) accordingly brakes the holdfast when the spring that raises it is broken.

11 Claims, 2 Drawing Sheets

FIG.2
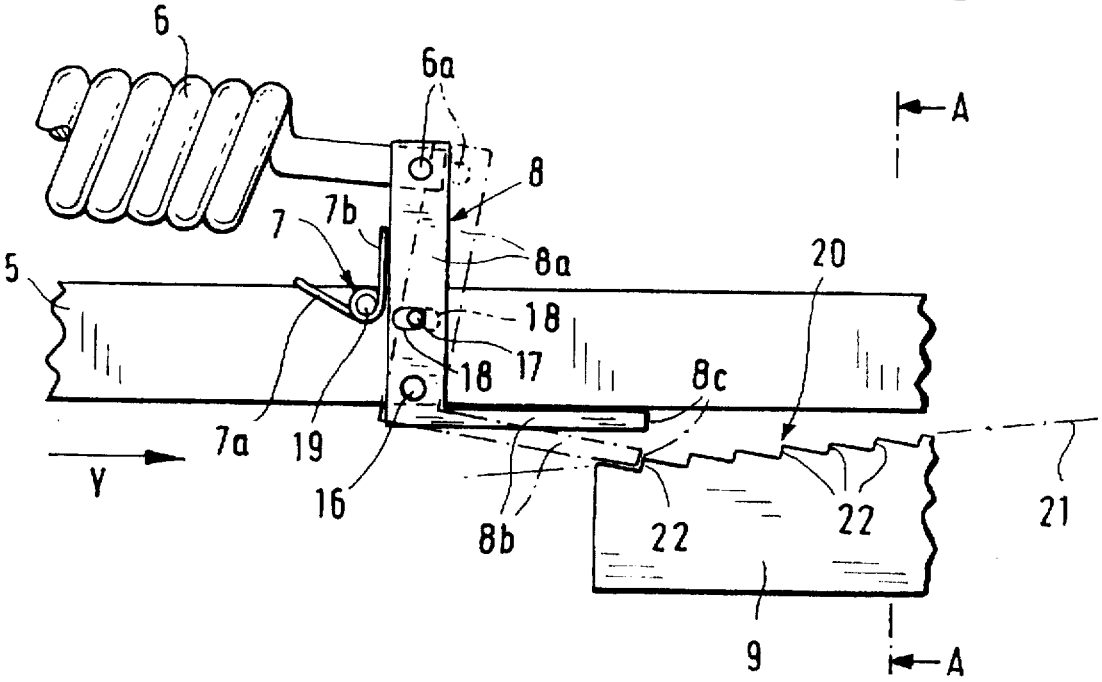
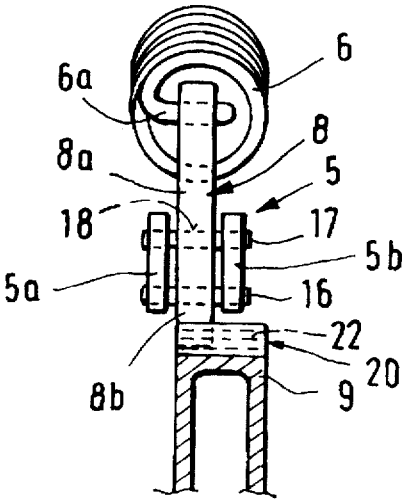
FIG.3

DEVICE FOR CUTTING SHEETS OF MATERIAL

BACKGROUND OF THE INVENTION

The present invention concerns a device for cutting sheets of material. It includes a counter for the material to rest on, a blade to cut the material, and a holdfast. The holdfast can be lowered onto the material by a mechanism and raised off it by a spring.

A device for cutting sheets of material with a counter for the material to rest on, a blade to cut the material, and a holdfast that can be lowered onto the material is known for example from European Patent 0 056 874 A1 for example. Such holdfasts are lowered onto the material by a mechanism and raised off it by a spring with the lowering mechanism out of action.

In practice, it is possible with such cutting devices to position the particular cut. The operator lowers the device slowly toward the material, and the proximity of the holdfast to the surface of the material plus the parallelism between the lower forward edge of the of the holdfast and the blade allows ideal orientation of the material in relation to the plane of the cut. It is generally impossible to prevent the operator from shifting the material between the holdfast. To prevent injury to the operator, especially to prevent his finger from getting caught, the pressure applied by the holdfast is decreased while the cut is being positioned. It is of course still possible for the operator to injure himself while the holdfast is being raised, when the mechanism is inactive and the spring that raises the holdfast is broken, allowing it to drop back onto the stack subject to its own weight. Serious injury to the operator in this event cannot be ruled out.

SUMMARY OF THE INVENTION

The object of the present invention is to improve the generic device to the extent that the operator cannot be injured when the holdfast-raising spring is broken.

This object is attained in accordance with the present invention in a device of the aforesaid genus by an interceptor that brakes the holdfast when the spring that raises it is broken. "Brake" is to be understood comprehensively in the present context. The braking is intended to ensure that the holdfast comes to rest either immediately or after only a short descent once the spring is broken, effectively preventing the holdfast from striking either the material or the operator's fingers. The holdfast is preferably braked by notching, which is a very simple mechanical procedure for braking it after only a short descent. It is in particular intended for the holdfast to notch indirectly. It is on the other hand conceivable to brake the holdfast directly, hydraulically for example. Such holdfasts are generally lowered hydraulically and the hydraulic system depressurized to allow the holdfast to rise. A broken holdfast-raising spring can be represented by increased pressure in the hydraulics, immediately actuating a valve that hydraulically prevents the holdfast from descending farther.

It is particularly simple from the engineering aspect to brake the holdfast when the spring that raises it is broken if the interceptor accommodates a detente component in the power train that leads to the holdfast, whereby a stationary stop extends into the path of the holdfast when the spring is broken. As long as the spring is intact, the detente component, which accompanies the holdfast, does not come into contact with the stop, whereas a broken spring leads to a variation in the adjustment of the detente component that leads in turn to the stop extending into the component's path.

Once the detente component comes into contact with the stop, the holdfast stops descending and is accordingly intercepted in that position.

The detente component in one advantageous embodiment pivots in the power train and between two stops, whereby the holdfast-raising spring engages a stationary component on the device and the detente component while a weaker release spring exerts force on the detente component in opposition to the force exerted by the holdfast-raising spring. As long as the holdfast-raising spring is intact, it will tension the detente component against one stop, whereby the path traveled by the detente component will always be remote from the stationary stop. If the holdfast-raising spring is broken and accordingly fails, the release spring will pivot the detente component against the other stop, and the stationary stop will again extend into the path of the detente component.

The interceptor can be at any position in the power train that terminates in the holdfast. It could basically be immediately next to the holdfast. The holdfast in one preferred embodiment, however, is accommodated in a frame, and the holdfast power train essentially comprises rods that engage each end of the holdfast, angled levers that pivot on the frame and engage the other end of the rods, a rod system that connects the levers, and a mechanism that operates in conjunction with one of the levers, whereby the holdfast raising spring engages the frame and the detente component, which is mounted in the connecting-rod system. In this event the detente component is associated with the lever-connecting rod that ensures simultaneity of the holdfast and rods.

The detente component in one particularly simple embodiment is angled and pivots at its vertex on the connecting-rod system, whereby the holdfast-raising spring engages one arm of the detente component and the free end of the other arm can operate in conjunction with the stationary stop. If the arms of the detente component are at a right angle, the holdfast-raising spring will be able to intervene very powerfully, and the other arm will be exposed essentially only to compressive forces when the holdfast-raising spring is broken, leading to impact against the stationary stop. It is practical for the release spring to be a leg spring accommodated in the connecting-rod system with one leg resting against the connecting-rod system and the other against the detente component between the component's pivot and the holdfast-raising spring's point of intervention. The detente component's two stops can for example be pins extending remote from the pivot through a slot in the component that extends along the direction it pivots in.

The stationary stop in one particular embodiment has a sliding detente that allows engagement of the detente component in accordance with the interception position of the holdfast. The background here is that the connecting-rod system mounted in the two angled levers moves along the arc of a circle in accordance with the position of the holdfast, with the consequence that the detente lever will complete a similar motion as long as the holdfast-raising spring is intact. To ensure rapid braking of the holdfast no matter what position it is in when the holdfast-raising spring is broken, the sliding detente, with its large number of notches for the detente component, is at almost the same distance from any position of the detente lever.

Further characteristics of the present invention will be evident from the subsidiary claims, the description of the figures, and the figures themselves. All characteristic and combinations thereof are essential to the invention.

BRIEF DESCRIPTION OF THE DRAWINGS

One embodiment of the present invention will now be specified without limiting its scope in any way with reference to the accompanying drawing, wherein FIG. 2 is a larger-scale illustration of the detail x in FIG. 1, and FIG. 3 is a section along the line A—A in FIG. 2.

DESCRIPTION OF THE PREFERRED EMBODIMENTS

Figure 1:
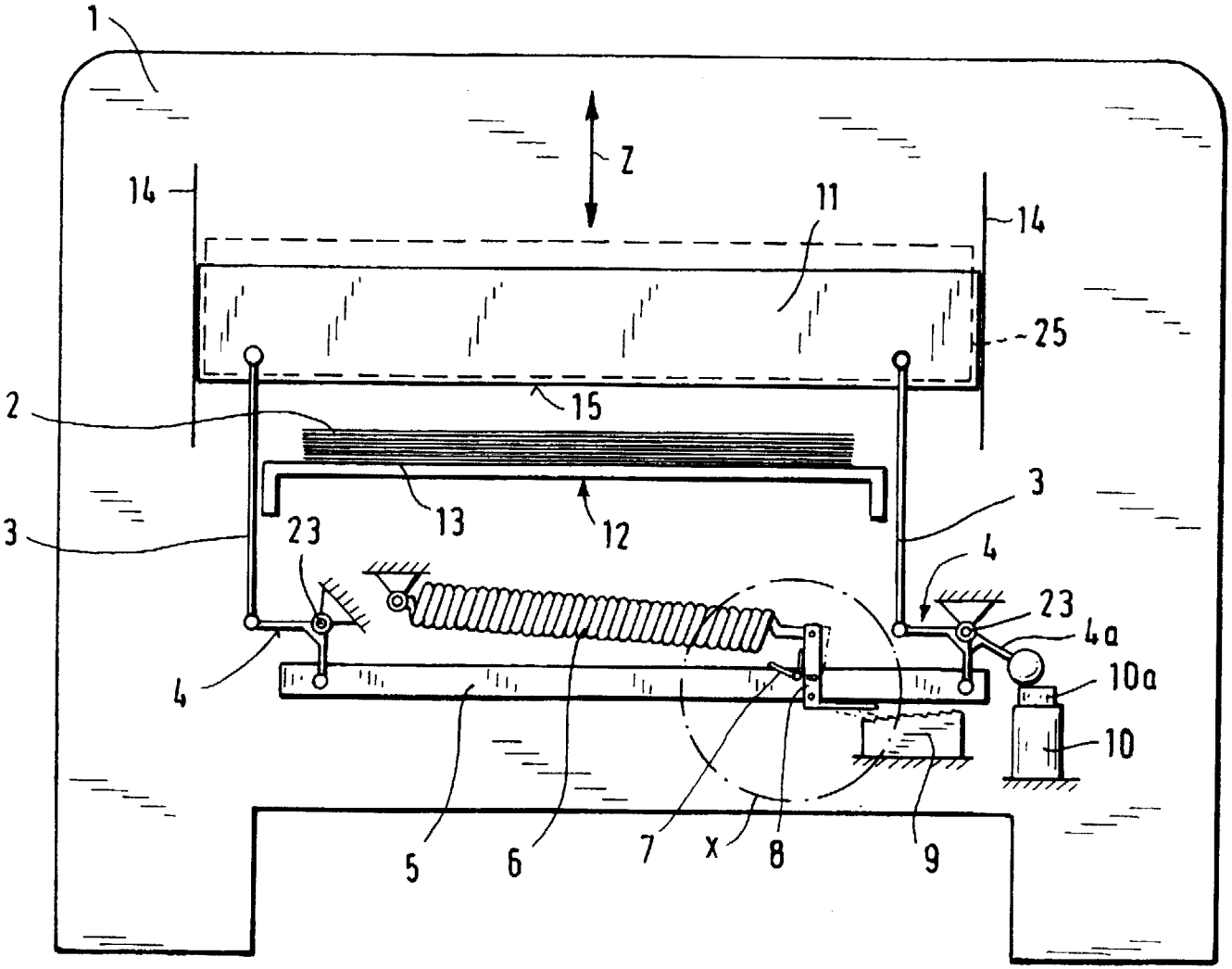
FIG. 1 is a schematic representation of a device for cutting sheets of material.

FIG. 1 represents the basic design of a device for cutting sheets of material along a plane perpendicular to the direction the material is being advanced in and parallel to the direction traveled by the holdfast and blade 25. Only the essential parts of the device are illustrated.

As will be evident from FIG. 1, a counter 12 with a horizontal top 13 that supports the sheets 2 of material is accommodated in a frame 1. A holdfast 11 ascends and descends in the direction indicated by double-headed arrow Z in two parallel and perpendicular tracks 14. FIG. 1 illustrates holdfast 11 in its uppermost position. The distance separating the upper surface of sheets 2 from the lower edge 15 of holdfast 11 will be evident.

Two parallel rods 3 engage the sides of holdfast 11. Rods 3 pivot on angled levers 4. Levers 4 pivot in turn in frame 1. The other end of each angled lever 4 pivots on a connecting-rod system 5, which accordingly mechanically couples rods 3, creating a ganged track for holdfast 11. One angled lever 4 has a third arm **4*a* that functions as an actuating arm. The free end of arm 4*a* extends into the positioning path of the piston 10*a*. Piston 10*a* operates in conjunction with a hydraulic cylinder 10. Cylinder 10 is accommodated in frame 1. As piston 10*a* travels out, the activating arm 4*a*, which rests against it, of the angled lever 4 next to cylinder 10 will pivot along with the rigidly integrated lever 4. The lever will accordingly not only draw its associated rod 3 down but transmit its motion to the other angled lever 4 by way of connecting-rod system 5. Rod system 5 will then draw its associated rod 3 down. The synchronized motion of both rods 3 will draw holdfast 11 down, in order to position the cut for example. Holdfast 11 is raised by depressurizing cylinder 10, whereupon a holdfast-raising spring 6 that engages both frame 1 and, indirectly, connecting-rod system 5 will apply force to the connecting-rod system, pivoting angled lever 4 against the direction the force is applied in when the hydraulics are in action. Holdfast-raising spring 6** is a spiral tension spring.

The design of the interceptor in accordance with the present invention will be evident from FIGS. 2 and 3 in particular. Connecting-rod system 5 comprises two parallel rods **5*a* and 5*b*. Rods 5*a* and 5*b* pivot, accommodating between them not only the free arms of angled levers 4 but also an angled detente component 8. A bolt 16 extends snugly through concentric bores in rods 5*a* and 5*b* and loosely through a bore at the vertex of angled detente component 8. Another bolt 17, remote from bolt 16, extends snugly through rods 5*a* and 5*b* and loosely through a slot 18 that is concentric with secured bolt 16 in the essentially perpendicular arm 8*a* of angled detente component 8. The end 6*a* of holdfast-raising spring 6 is suspended in a hole in the vicinity of the free end, which faces away in bolt 16, of arm 8*a*. Another bolt 19 (FIG. 1) extends snugly through concentric bores in rods 5*a* and 5*b* on the side facing holdfast-raising spring 6. Bolt 19 also extends through a leg spring 7. One leg 7*a* of leg spring 7 rests against the end of connecting-rod system 5 facing holdfast-raising spring 6. The other leg 7*b* rests against the arm 8*a* of angled detente component 8. Angled detente component 8 has another arm 8*b* perpendicular to arm 8*a* and to the length of its bearing bolt 16*a***.

As holdfast 11 moves, connecting-rod system 5 describes, due to its pivoting on both angled levers 4, a motion along the circumference of a circle with a radius equal to the lifting arm of levers 4 between the bearing axis 23 and the point of intervention against connecting-rod system 5. While holdfast 11 is up, holdfast-raising spring 6 is less powerfully tensioned and, when it is farther down, more powerfully tensioned. Holdfast-raising spring 6 draws angled detente component 8 into the position represented by the solid lines in FIG. 2, where bolt 17 rests against one end of slot 18. Without holdfast-raising spring 6, which means when it is broken and is out of action, it is leg spring 7 that ensures angled detente component 8 is pivoted into the position represented by the broken lines in FIG. 2. In this event the bolt 17 at the other end of slot 18 will rest against arm **8*a***.

The figures reveal how a stop 9 mounted in frame 1 and accordingly stationary operates in conjunction with the arm **8*b* of angled detente component 8. The end of stop 9 facing arm 8*b* constitutes a sliding detente 20. The contour 21 of sliding detente 20, which is not actually illustrated in the vicinity of the detente itself, slants, ensuring that, as long as holdfast-raising spring 6 acts on angled detente component 8, free end 8*c* will remain at the same slight distance away from contour 21 no matter what the position of holdfast 11. If holdfast-raising spring 6 is broken, leg spring 7 will pivot angled detente component 8 into the position represented by the broken line. The free end 8*c* of arm 8*b* will come to rest in one of the notches 22 in sliding detente 20, preventing connecting-rod system 5 from moving any farther in the direction indicated by arrow Y. The braking of connecting-rod system 5 will, by way of the kinematic coupling associated with holdfast 11, stop the holdfast when holdfast-raising spring 6 is broken. Which notch 22 in sliding detente 20 angled detente component 8 will encounter depends on what position holdfast 11 is in when holdfast-raising spring 6 is broken. The broken line in FIG. 2 illustrates the braking action in the event that holdfast-raising spring 6 is broken while holdfast 11 is almost all the way up. If the spring is broken with the holdfast farther down, connecting-rod system 5 would travel farther in the direction indicated by arrow Y, and the free end 8*c* of arm 8 would come into contact with on of the rear notches 22. The invisible notches 22** are included in FIG. 3 to facilitate comprehension.

We claim:

1. An arrangement for cutting sheets of material, comprising: support means for holding the material; a blade spaced from said support means for cutting the material while held in said support means; a holdfast adjacent said blade and lowerable onto the material for securing the material to be cut in said support means; means connected to said holdfast for lowering said holdfast; spring means connected to said holdfast for raising said holdfast off the material; and interceptor means on said holdfast for braking said holdfast when said spring means raising said holdfast breaks.

2. An arrangement as defined in claim 1, wherein said interceptor means has means for engaging a detente to prevent dropping of said holdfast when said spring means is broken.

3. An arrangement as defined in claim 2, wherein said detente component has a vertex on said rod system, said detente component being angled and pivoting at said vertex on said rod system; said detente component having a first arm engaging said spring means; a stationary stop extending into a path of said holdfast when said spring means is broken; said detente component having a second arm with a free end operating in conjunction with said stationary stop.

4. An arrangement as defined in claim 3, wherein said stationary stop has a sliding detente for allowing engagement of said detente component with an interception position of said holdfast.

5. An arrangement as defined in claim 1, including a power train leading to said holdfast; and a stationary stop extending into a path of said holdfast when said spring means is broken, said interceptor means comprising a detente component in said power train.

6. An arrangement as defined in claim 5, including two additional stops, said detente component pivoting in said power train between said two additional stops, said spring means being a first spring; a stationary component and a second spring, said first spring engaging said stationary component and said detente component and said second spring exerting a force on said detente component in opposition to a force exerted by said first spring, said second spring being weaker than said first spring.

7. An arrangement as defined in claim 6, wherein said two stops comprise a bolt mounted in a rod system extending remote from an axis of said detente component and extending in a pivoting direction of said detente component.

8. An arrangement as defined in claim 1, wherein said means for lowering said holdfast comprises a hydraulic cylinder pivoting said holdfast.

9. An arrangement for cutting sheets of material, comprising: support means for holding the material; a blade spaced from said support means for cutting the material while held in said support means; a holdfast adjacent said blade and lowerable onto the material for securing the material to be cut in said support means; means connected to said holdfast for lowering said holdfast; spring means connected to said holdfast for raising said holdfast off the material; and interceptor means on said holdfast for braking said holdfast when said spring means raising said holdfast breaks; a power train leading to said holdfast; and a stationary stop extending into a path of said holdfast when said spring means is broken, said interceptor means comprising a detente component in said power train.

10. An arrangement as defined in claim 9, including a frame for accommodating said holdfast; said power train comprising substantially rods having each one end engaging said holdfast; angled levers pivoting on said frame and engaging another end of said rods; a rod system connecting said levers; and means operating in conjunction with one of said levers to engage said spring means with said frame and said detente component, said detente component being mounted in said rod system.

11. An arrangement for cutting sheets of material, comprising: support means for holding the material; a blade spaced from said support means for cutting the material while held in said support means; a holdfast adjacent said blade and lowerable onto the material for securing the material to be cut in said support means; means connected to said holdfast for lowering said holdfast; spring means connected to said holdfast for raising said holdfast off the material; and interceptor means on said holdfast for braking said holdfast when said spring means raising said holdfast breaks; said interceptor means having means for engaging a detente to prevent dropping of said holdfast when said spring means is broken; a power train leading to said holdfast; a stationary stop extending into a path of said holdfast when said spring means is broken, said interceptor means comprising a detente component in said power train; two additional stops, said detente component pivoting in said power train between said two additional stops, said spring means being a first spring; a stationary component and a second spring weaker than said first spring, said first spring engaging said stationary component and said detente component and said second spring exerting a force on said detente component in opposition to a force exerted by said first spring; a frame for accommodating said holdfast; said power train comprising substantially rods having each one end engaging said holdfast; angled levers pivoting on said frame and engaging another end of said rods; a rod system connecting said levers; means operating in conjunction with one of said levers to engage said spring means with said frame and said detente component, said detente component being mounted in said rod system; said detente component having a vertex on said rod system, said detente component being angled and pivoting at said vertex on said rod system; said detente component having a first arm engaging said spring means; said detente component having a second arm with a free end operating in conjunction with said stationary stop; said stationary stop having a sliding detente for allowing engagement of said detente component with an interception position of said holdfast; said two stops comprising a bolt mounted in said rod system extending remote from an axis of said detente component and extending in a pivoting direction of said detente component; said means for lowering said holdfast comprising a hydraulic cylinder pivoting said holdfast.

* * * * *